US010548789B2

(12) United States Patent
Dyevich et al.

(10) Patent No.: US 10,548,789 B2
(45) Date of Patent: Feb. 4, 2020

(54) METHODS AND SYSTEMS FOR A DYNAMIC SUPPORT MATTRESS TO TREAT AND REDUCE THE INCIDENCE OF PRESSURE ULCERS

(71) Applicant: Off-Loading Technologies Inc., Tarrytown, NY (US)

(72) Inventors: Michael Dyevich, Katonah, NY (US); Glenn Butler, Tarrytown, NY (US)

(73) Assignee: Offloading Technologies Inc., Tarrytown, NY (US)

( * ) Notice: Subject to any disclaimer, the term of this patent is extended or adjusted under 35 U.S.C. 154(b) by 572 days.

(21) Appl. No.: 15/069,962

(22) Filed: Mar. 14, 2016

(65) Prior Publication Data

US 2016/0193096 A1 Jul. 7, 2016

Related U.S. Application Data

(63) Continuation of application No. 13/631,094, filed on Sep. 28, 2012, now Pat. No. 9,295,599.
(Continued)

(51) Int. Cl.

| | |
|---|---|
| ***A47C 27/14*** | (2006.01) |
| ***A61G 7/057*** | (2006.01) |
| ***A47C 27/15*** | (2006.01) |

(52) U.S. Cl.
CPC ..... *A61G 7/05715* (2013.01); *A47C 27/142* (2013.01); *A47C 27/144* (2013.01);
(Continued)

(58) Field of Classification Search
CPC ..... A61G 7/057; A61G 7/05715; A61G 7/05723; A47C 27/14; A47C 27/142;
(Continued)

(56) References Cited

U.S. PATENT DOCUMENTS 2,462,579 A * 2/1949 Warner ..... A47C 27/146 5/722
3,146,469 A * 9/1964 Slade ..... A47C 27/144 5/695

(Continued)

OTHER PUBLICATIONS

International Search Report and Written Opinion in counterpart International Application No. PCT/US2012/058028 dated Jan. 7, 2013.

(Continued)

*Primary Examiner* — David R Hare
(74) *Attorney, Agent, or Firm* — Dugan & Dugan, PC

(57) ABSTRACT

Systems, methods, and apparatus are provided for preventing and treating pressure ulcers in bedfast patients. The invention includes providing a non-powered mattress having a first zone adapted to conform to a first body part and a second zone adapted to provide support to a second body part, and off-loading interface pressure on the first body part to the second body part by dynamically increasing the support provided to the second body part by the second zone based on a weight of the first body part on the first zone. The off-loading of interface pressure from the first body part to the second body part equalizes blood oxygen saturation in tissue of the first and second body parts. Numerous additional aspects are disclosed.

9 Claims, 4 Drawing Sheets

Related U.S. Application Data

(60) Provisional application No. 61/542,144, filed on Sep. 30, 2011.

(52) U.S. Cl.
CPC ..... *A47C 27/146* (2013.01); *A47C 27/148* (2013.01); *A47C 27/15* (2013.01); *A61G 7/05723* (2013.01)

(58) Field of Classification Search
CPC ..... A47C 27/144; A47C 27/148; A47C 27/15; A47C 27/146
See application file for complete search history.

(56) References Cited

U.S. PATENT DOCUMENTS 3,363,272 A * 1/1968 Channon ..... A47C 17/64 441/129
3,378,861 A * 4/1968 Lousberg ..... A47C 27/146 5/733
3,419,920 A 1/1969 Maddux, Jr. et al.
3,451,071 A * 6/1969 Whiteley ..... A47C 27/146 5/630
3,623,170 A * 11/1971 Staley ..... A47C 27/146 5/695
3,626,526 A * 12/1971 Viel ..... A47C 27/148 5/722
3,639,927 A * 2/1972 Munch ..... A47C 27/146 5/723
3,742,528 A * 7/1973 Munch ..... A47C 27/148 5/723
3,828,378 A * 8/1974 Flam ..... A61G 7/05707 5/730
3,846,857 A * 11/1974 Weinstock ..... A47C 27/148 5/722
4,053,957 A * 10/1977 Regan ..... A47C 23/00 5/727
4,316,298 A 2/1982 Russo et al.
4,356,578 A 11/1982 Clark
4,522,447 A 6/1985 Snyder et al.
4,571,763 A 2/1986 Suzuyama et al.
4,706,313 A * 11/1987 Murphy ..... A47C 27/148 5/722
RE32,734 E 8/1988 McLeod
4,819,288 A 4/1989 Lowthian
5,031,261 A 7/1991 Fenner
5,048,167 A 9/1991 Heffley et al.
5,179,742 A * 1/1993 Oberle ..... A47C 27/22 5/727
5,231,717 A * 8/1993 Scott ..... A47C 27/148 5/400
5,282,286 A 2/1994 MacLeish
5,369,824 A 12/1994 Powell
5,474,362 A 12/1995 Albecker
5,513,402 A 5/1996 Schwartz
5,524,640 A * 6/1996 Lisak ..... A47D 13/08 128/869
5,671,492 A 9/1997 Simon
5,802,646 A 9/1998 Stolpmann et al.
5,966,763 A 10/1999 Thomas et al.
6,115,861 A 9/2000 Reeder et al.
6,202,239 B1 3/2001 Ward et al.
6,223,369 B1 5/2001 Maier et al.
6,230,351 B1 * 5/2001 Kohnle ..... A47C 27/148 5/648
6,269,504 B1 8/2001 Romano et al.
6,442,780 B1 * 9/2002 Phillips ..... A47C 27/146 5/730
6,662,393 B2 * 12/2003 Boyd ..... A47C 27/144 5/727
6,701,558 B2 3/2004 VanSteenburg
6,829,799 B2 * 12/2004 Kuhn ..... A47C 27/146 5/648
7,020,918 B1 * 4/2006 Tinsley ..... A47C 16/00 5/630
7,191,483 B2 * 3/2007 Hochschild ..... A47C 27/001 5/691
7,194,778 B2 * 3/2007 Riach ..... A47C 20/026 5/727
7,941,883 B2 * 5/2011 Moule ..... A47C 27/144 5/727
8,245,341 B2 * 8/2012 Oh ..... A47C 27/144 5/722
8,590,075 B1 11/2013 Amjad et al.
8,607,387 B2 12/2013 Flick
8,832,889 B2 * 9/2014 Sportis ..... A47C 27/144 5/727
9,295,599 B2 * 3/2016 Dyevich ..... A61G 7/05715
9,854,922 B1 * 1/2018 Schiller ..... A47C 27/146
10,258,164 B2 * 4/2019 Shi ..... A47C 27/001
2002/0029425 A1 3/2002 Henley
2004/0003471 A1 * 1/2004 VanSteenburg ..... A47C 27/081 5/709
2005/0262637 A1 * 12/2005 Funatogawa ..... A47G 9/10 5/636
2006/0075569 A1 4/2006 Giori et al.
2007/0151033 A1 7/2007 Wyatt et al.
2009/0013470 A1 1/2009 Richards et al.
2010/0218319 A1 9/2010 Moule
2011/0154576 A1 6/2011 Warren et al.
2011/0173758 A1 7/2011 Fontaine
2012/0192357 A1 8/2012 Melsen
2013/0081208 A1 4/2013 Dyevich et al.
2015/0026895 A1 1/2015 Geelen et al.

OTHER PUBLICATIONS

Office Action of U.S. Appl. No. 13/631,094 dated Aug. 2, 2013.
Dec. 2, 2013 Reply to Aug. 2, 2013 Office Action of U.S. Appl. No. 13/631,094.
Final Office Action of U.S. Appl. No. 13/631,094 dated Feb. 27, 2014.
Examiner Interview Summary of U.S. Appl. No. 13/631,094 dated May 21, 2014.
May 27, 2014 Response & Request for Consideration under PP 2.0 to Feb. 27, 2014 Final Office Action of U.S. Appl. No. 13/631,094.
Office Action of U.S. Appl. No. 13/631,094 dated Aug. 14, 2014.
Dec. 15, 2014 Response to Aug. 14, 2014 Office Action of U.S. Appl. No. 13/631,094.
Final Office Action of U.S. Appl. No. 13/631,094 dated Feb. 27, 2015.
Amendment Submitted with filing of RCE of U.S. Appl. No. 13/631,094, filed Aug. 27, 2015.
Applicant-Initiated Interview Summary of U.S. Appl. No. 13/631,094 dated Jul. 16, 2015.
Notice of Allowance and Applicant-Initiated Interview Summary of U.S. Appl. No. 13/631,094 dated Nov. 19, 2015.

* cited by examiner

METHODS AND SYSTEMS FOR A DYNAMIC SUPPORT MATTRESS TO TREAT AND REDUCE THE INCIDENCE OF PRESSURE ULCERS

RELATED APPLICATIONS

The present application is a continuation of and claims priority from U.S. patent application Ser. No. 13/631,094, filed Sep. 28, 2012, entitled "METHODS AND SYSTEMS FOR A DYNAMIC SUPPORT MATTRESS TO TREAT AND REDUCE THE INCIDENCE OF PRESSURE ULCERS" which claims priority from U.S. Provisional Patent Application Ser. No. 61/542,144, filed Sep. 30, 2011, entitled "METHODS AND SYSTEMS FOR A DYNAMIC SUPPORT MATTRESS TO TREAT AND REDUCE THE INCIDENCE OF PRESSURE ULCERS" and which are both hereby incorporated herein by reference in their entirety for all purposes.

FIELD

The present invention relates generally to mattresses, and more specifically to therapeutic support mattresses that treat and reduce the incidence of pressure ulcers.

BACKGROUND

The development of pressure ulcers among hospital and nursing home patients remains one of the greatest preventable challenges to healthcare worldwide. It is estimated that in 2011 in the United States alone, costs related to the prevention and management of pressure ulcers at home and in clinical settings exceeds three billion dollars annually.

Patients immobilized and unable to move can suffer serious destruction of the skin and soft body tissue in as little as one hour. This often results in the formation of a pressure ulcer. A pressure ulcer is defined as any lesion caused by unrelieved pressure resulting in underlying tissue damage. Complications related to pressure ulcers cause an estimated 60,000 deaths in the United States annually. However, most pressure ulcers are treatable and even preventable.

Patients that have difficulty moving while in bed are at risk with the highest risk for pressure ulcer development being among diabetic, insensate, and paraplegic patients. Accordingly, dozens of mattress designs have been produced over the years to help better distribute or periodically reduce pressure on anatomical areas of the body at high risk for the development of pressure ulcers. For example, the microAIR Therapeutic Support Systems manufactured by Invacare Corporation of Cleveland, Ohio provides a pneumatic mattress with alternating zones to change the points of support. To date however, all the scientific data that has been developed to support mattress manufacturer claims has been based on interface (mmHg) pressure point measurements over time using an empirical algorithm to estimate tissue ischemia in an attempt to predict pressure ulcer development.

The inventors of the present invention have determined that this approach is unreliable. Therefore, what is needed are methods and systems to determine an off-loading mattress design and/or clinical procedure that will reduce the incidence of pressure ulcers and to provide treatment for all stages (e.g., 1 through 4) of pressure ulcers.

SUMMARY

In some aspects of the invention, a method of preventing and treating pressure ulcers in bedfast patients is provided.

The method includes providing a non-powered mattress having a first zone adapted to conform to a first body part and a second zone adapted to provide support to a second body part, and off-loading interface pressure on the first body part to the second body part by dynamically increasing the support provided to the second body part by the second zone based on a weight of the first body part on the first zone. The off-loading of interface pressure from the first body part to the second body part equalizes blood oxygen saturation in tissue of the first and second body parts.

In some other aspects of the invention, a mattress for preventing and treating pressure ulcers in bedfast patients is provided. The inventive the mattress includes a base structure formed from a first foam material having a first density; a core layer formed from a second foam material having a second density; and a top layer formed from a third foam material having a third density. The core layer is adapted to fit into a well in the base structure and the top layer is adapted to cover the core layer and at least a portion of the base structure.

In yet other aspects of the invention, a mattress for preventing and treating pressure ulcers in bedfast patients is provided. The mattress includes a first zone adapted to support a scapular area of a patient, a second zone adjacent the first zone and adapted to support at least a sacrum area of the patient, and a third zone adjacent the second zone and adapted to support a leg area of the patient. The second zone includes a structure adapted to compress the first and third zones based on weight applied to the second zone, and compressing the first zone increases the support provided to the patient by the first zone and compressing the third zone increases the support provided to the patient by the third zone.

Other features and aspects of the present invention will become more fully apparent from the following detailed description, the appended claims and the accompanying drawings.

DETAILED DESCRIPTION

Figure 1:
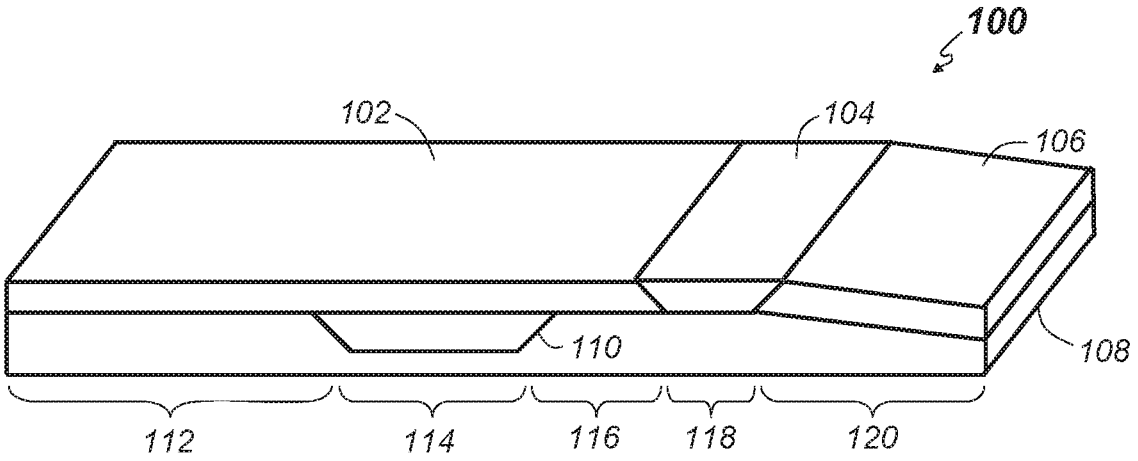
FIG. 1 illustrates a perspective view depicting an example mattress according to embodiments.

Embodiments of the present invention provide a low-cost, non-powered mattress adapted to treat and reduce the occurrence of pressure ulcers in bedfast patients by dynamically off-loading weight from critical anatomical areas. The mattress includes several zones that include material of varying densities, indention force deflection (IDF) values, and shapes which work together to avoid restrictions in oxygenated blood flow.

Unlike prior attempts to treat and avoid pressure ulcers, embodiments of the present invention do not rely on merely reducing or equalizing interface pressure across the entire body. The inventors of the present invention have determined that interface pressure measurement alone is not an accurate predictor of the development of pressure ulcers in bedfast patients and interface pressure alone should not be used to evaluate mattresses. Instead, the mattress according to embodiments of the present invention equalizes blood oxygen saturation around anatomical areas that have bony prominences to avoid ischemia which would otherwise lead to pressure ulcers. The inventors have determined that anatomical site location pressure and oxygen saturation do not necessarily inversely correlate. This means that a relatively high interface pressure does not necessarily result in lower tissue oxygen saturation and lower interface pressures does not always result in higher oxygen saturations.

Tissue ischemia and ischemia reperfusion injury are one of the primary contributors to the formation of pressure sores or ulcers. Pressure upon tissues, especially those over the bony prominences of the body can be detrimental to cellular function, particularly if incurred for prolonged periods of time. In general, damage to tissues is less likely when the pressure of the body is evenly distributed over a wide area then if the pressure is localized at, and or over some pressure point. Time is also important factor in the consideration of tissue pressure and breakdown. Lower levels of pressure maintained for long periods of time produce more tissue damage than high pressure for short periods. In other words, in some instances time may be a more detrimental factor than actual pressure. Even the intermittent relief of pressure may allow for delivery of adequate nutrients to the cellular level.

Since patients may be in bed for eight hours or more, the mattress in use becomes a significant variable in the reduction and or relief of pressure on the patient's body, particularly over bony prominences. An increase in mechanical stress (pressure and shear) decreases the availability of nutrients, such as oxygen. Long interface pressure periods applied to tissue decreases blood flow to the subcutaneous tissue, which results in hypoxia. Hypoxia forces cells to use anaerobic pathways to produce energy, more lactic acid will accumulate, more acidosis and hydrogen ions, and more potassium becomes available around the cell. These factors lead to vasodilatation to help attract more blood and oxygen to the tissues. This is useful with a healthy cardiovascular system. However, if pressure continues, this defense mechanism will fail.

In patients with paraplegia, atherosclerosis, or cardiovascular failure, for example, the blood vessels dilate less efficiently and blood will not move into the hypoxic area. If pressure continues longer, more metabolites will accumulate and ischemia will result in cell death and necrosis. On the other hand, if the patient's position is changed after the ischemia, pressure will be released, and normal blood flow will resume. This reactive hyperemia will lead to reperfusion injury by generating free radicals. The tissue becomes more susceptible to necrosis upon repeating these events, and ultimately may become infected.

Reactive Hyperemia (RH) is a hallmark of reperfusion injury and pressure ulcer development. Thus, the mattress of the present invention includes features that may result in uneven interface pressure but avoids RH.

In some embodiments, the invention may use various types of foam (polyurethane, memory Foam, synthetic latex, latex, or the like) in a multi-zoned, multi-layered mattress construction to provide a relatively low pressure support environment. This allows maximum immersion, enveloping all bony prominences in a three dimensional format (length, width, and height) and to conform the mattress to the anthropometric characteristics of the human body in supine, prone, and lateral (e.g., side-laying) positions. The arrangement according to one or more embodiments of the present invention also dramatically lowers vertical and horizontal shear forces while allowing the subcutaneous muscle tissue next to the bone to have the highest levels of oxygen saturation to support tissue viability for prevention and healing of any stage pressure ulcer.

Using near-infrared spectroscopy, a non-invasive method to continuously measure subcutaneous oxygen in deep muscle tissue proximate to bone, the inventors were able to determine the material types, densities, indentation force deflections (IFDs), and shapes that allowed the highest levels of oxygen saturation, particularly in tissue adjacent bony prominences. In some embodiments, five separate zones may be used to both provide firmness where the body needs support and softness to envelop bony prominences. Going from the head end of the mattress to the heel end, the five zones may include the scapular zone, the sacrum/ischium/trochanter zone, the thigh zone, the calf zone and the heel zone.

In some embodiments, the scapular zone may include an approximately 5.5" densificated polyurethane foam layer covered with an approximately 2.5" top layer of synthetic latex foam. This structure conforms to, off-loads, and equalizes the pressure on the scapular.

In some embodiments, the sacrum/ischium/trochanter zone may include an approximately 2" densificated polyurethane foam base layer, an approximately 3.5" memory foam core layer, and an approximately 2.5" synthetic latex foam top layer. This structure allows for deep immersion of the sacrum and trochanter in a supine, side-laying and various head of bed elevations (e.g., 0, 15, 30, 45 degrees). The edges of the core layer of the sacrum/ischium/trochanter zone maybe cut at angles to create a gradual density transition from the scapular zone and to the thigh zone. As will be discussed in detail below, the angled edges of the core layer of the sacrum/ischium/trochanter zone may be adapted to transfer vertical downward pressure in lateral directions. This dynamically increases the density of the adjacent zones, which in turn provides more support to the body areas contacting the increased density areas of the mattress and off-loads the pressure on the sacrum/ischium/trochanter.

In some embodiments, the thigh zone may include an approximately 5.5" densificated polyurethane foam layer covered with an approximately 2.5" top layer of synthetic latex foam. This structure conforms to, off-loads, and equalizes the pressure on the thighs.

In some embodiments, the calf zone utilizes approximately 2.5" layer of relatively higher density polyurethane foam over a base layer of approximately 5.5" of densificated polyurethane foam. This facilitates elevating the calves and off-loading the heels allowing deep tissue oxygenation to remain at base line levels.

In some embodiments, the heel zone incorporates relatively soft vertical cell polyurethane foam to envelop the heels and provide relatively low interface pressures, greatly reducing the risk of pressure ulcer formation on the pressure sensitive heels. In some embodiments, the heel zone uses approximately 2.5" layer of vertical cell polyurethane foam over a slanting base layer of approximately 5.5" of densificated polyurethane foam adjacent the calf zone that gradients down to approximately 3" thick at the heel end of the mattress.

In some embodiments, a shear liner is used to help to transfer vertical and horizontal forces away from the body by allowing the top layer to move independently of the lower components of the mattress.

Turning to FIG. 1, a perspective drawing depicting an embodiment of and example mattress 100 according to one or more embodiments the present invention is provided. The mattress 100 may include a top layer 102, a calf pillow 104, a heel cushion 106, a base structure 108, and a core layer 110 arranged as shown. In some embodiments additional or fewer components may be included. For example, in some embodiments additional core layers may be disposed at different locations such as, for example within the region of the scapular.

Figure 8A:
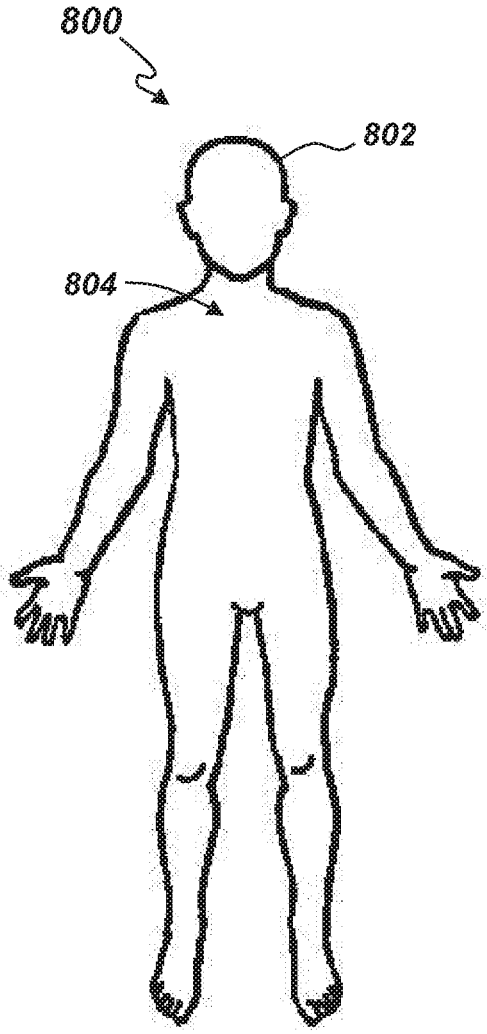
FIGS. 8A and 8B are simplified front and posterior line drawings, respectively, of a human body identifying anatomical features or areas relevant to embodiments of the present invention.
Figure 8B:
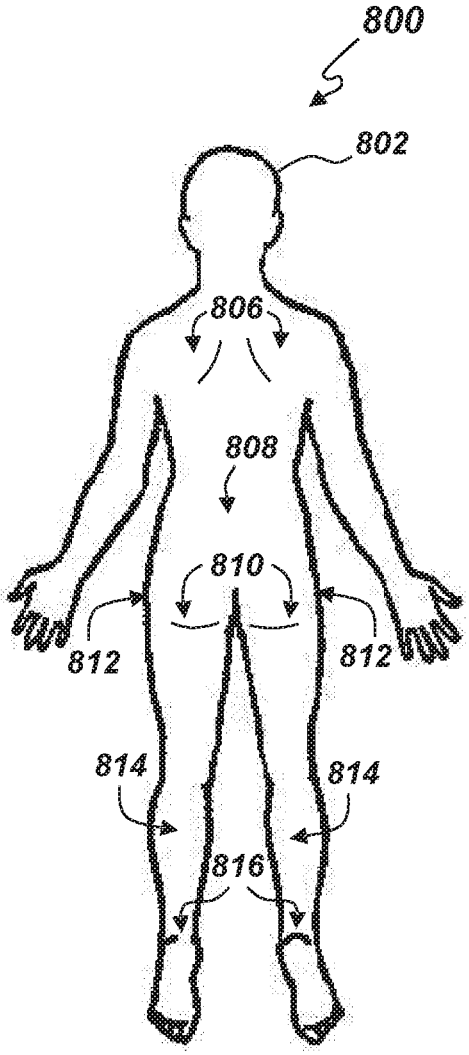

The particular structure depicted in FIG. 1 results in a mattress that includes the five distinct zones discussed above. Other structures with five zones are possible as well. Further, in some embodiments, structures that result in more or fewer than five zones are possible. As indicated above, the example structure depicted in FIG. 1 includes, from the head end of the mattress 100 to the foot end of the mattress 100, a scapular zone 112, a sacrum/ischium/trochanter zone 114, a thigh zone 116, a calf zone 118 and a heel zone 120. Note that these zones correspond to anatomical features of a human body 800 as depicted in FIGS. 8A and 8B. The scapular zone 112 is designed to support the clavicle area 804 when the patient lies prone on the mattress 100 and to support the scapular area 806 when the patient lies supine on the mattress 100. The sacrum/ischium/trochanter zone 114 is designed to support the sacrum area 808 and the ischium area 810 when the patient lies supine on the mattress 100 and to support the trochanter area 812 when the patient is side-laying. The thigh zone 116 is designed to support the patient's thighs. The calf zone 118 is designed to support the patient's calves 814 so that the heels 816 are off-loaded. The heel zone 120 is designed to conform to the patient's heels 816.

Figure 2:
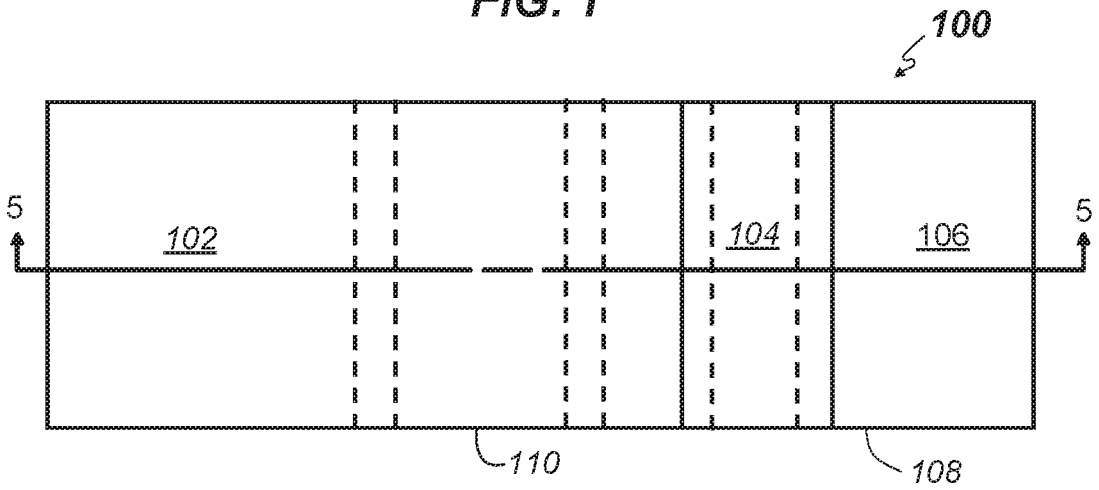
FIG. 2 illustrates a top view depicting an example mattress according to embodiments.
Figure 3:
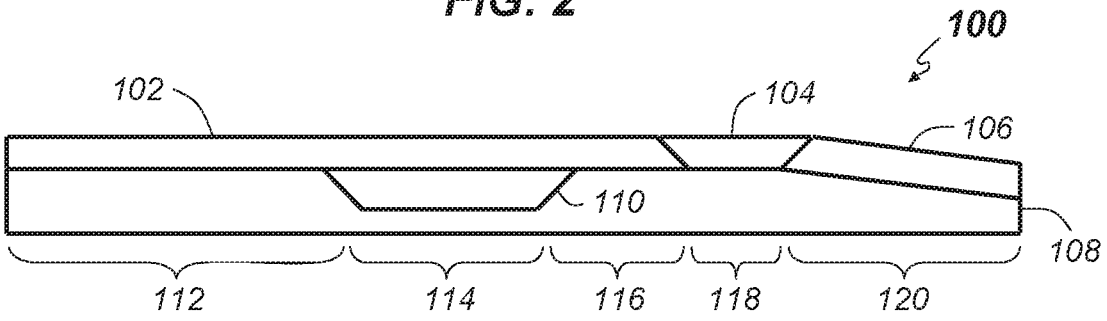
FIG. 3 illustrates a side view depicting an example mattress according to embodiments.
Figure 4:
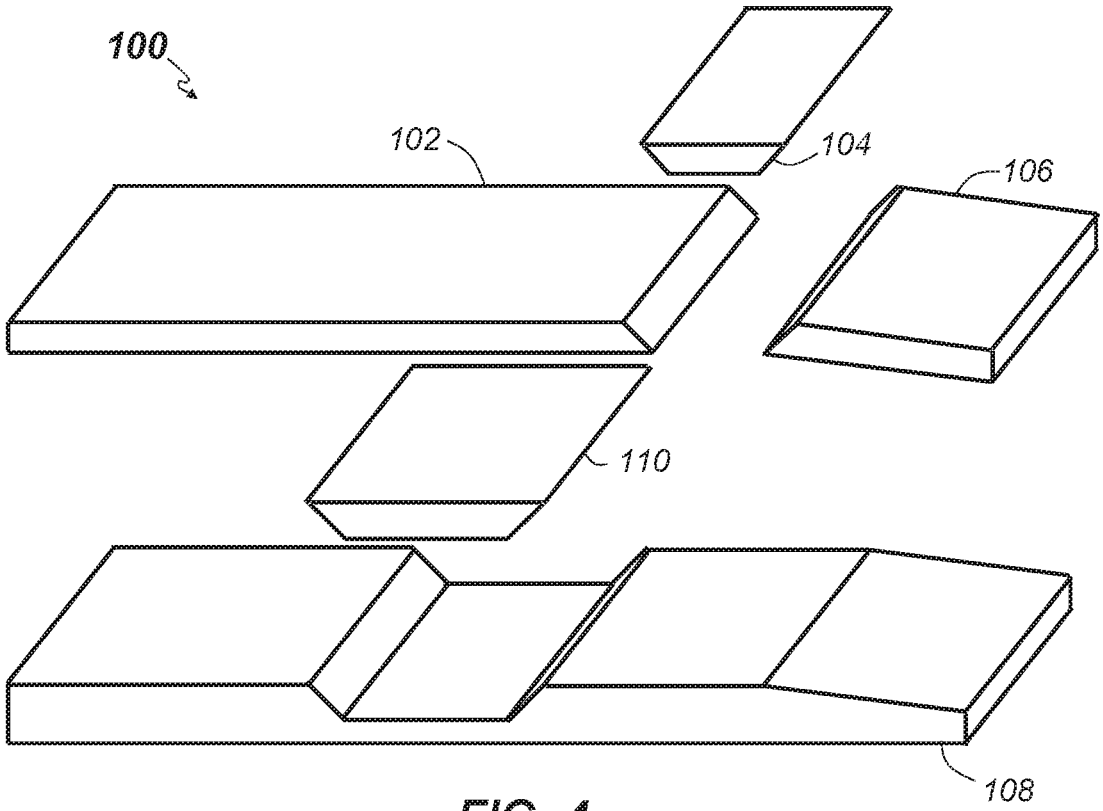
FIG. 4 illustrates an exploded perspective view depicting an example mattress according to embodiments.

Turning now to FIGS. 2 through 4, a top elevation view, a side elevation view, and an exploded perspective view respectively, of the example embodiment mattress 100 are provided. Note that the same reference numbers from FIG. 1 are used to indicate the same components as they appear in FIG. 2 through FIG. 4 and that the drawings are not necessarily drawn to scale. The following Table 1 provides example dimension ranges, materials, IFD ranges, and density ranges for each of the five components of the example mattress 100.

TABLE 1

Example dimension ranges, materials, IFD ranges, and density ranges for each of five mattress components.

| Component | Ref Num | Material | Density Range Nom/Max (lbs/ft$^3$) | IDF Range @25% Compress Nom/Max (lbs) | Outside Dimensions Nom/Min/Max (inches) |
|---|---|---|---|---|---|
| Top Layer | 102 | synthetic latex foam | 3.65 to 3.85<br>2.95 to 4.62 | 20 to 25<br>16 to 30 | 2.5 × 35 × 54<br>2 × 28 × 43<br>3 × 42 × 65 |
| Calf Pillow | 104 | higher density polyurethane foam | 1.8 to 1.9<br>1.44 to 2.28 | 30 to 38<br>24 to 46 | 2.5 × 7 × 35<br>2 × 5.6 × 43<br>3 × 8.4 × 65 |
| Heel Cushion | 106 | vertical cell polyurethane foam | 1.1 to 1.25<br>0.88 to 1.5 | 12 to 16<br>9 to 20 | 2.5 × 19 × 35<br>2 × 17 × 43<br>3 × 21 × 65 |
| Base Structure | 108 | Densificated polyurethane foam | 2 to 2.3<br>1.6 to 2.76 | 20 to 25<br>16 to 30 | 5.5 × 35 × 80<br>4.4 × 28 × 64<br>6.6 × 42 × 96 |
| Core Layer | 110 | visco-elastic polyurethane foam | 2.7 to 3.3<br>2.16 to 3.96 | 9 to 15<br>7 to 18 | 3.5 × 20 × 35<br>2.8 × 16 × 43<br>4.2 × 24 × 65 |

Firmness or IDF (indentation force deflection) is measured in terms of pounds of force according to ASTM #D3574 standard, which specifies the force required to deflect a 15"×15"×4" thick piece of material 25% (i.e., 1") of the original thickness (i.e., 4") using an eight inch diameter indentation foot.

A commercially available example of synthetic latex foam includes Qualatex Type M20375BN Foam manufactured by Carpenter Company located in Richmond, Va. A commercially available example of higher density polyurethane foam includes Type CMX30185GA Foam manufactured by Carpenter Company. A commercially available example of vertical cell polyurethane foam includes Type CX11115WT Foam manufactured by Carpenter Company. A commercially available example of densificated polyurethane foam includes OMALON Foam (Type CDX20215RS Foam) manufactured by the Carpenter Company. A commercially available example of visco-elastic polyurethane foam includes Type VX9300BG Foam manufactured by the Carpenter Company. Other similar practicable foams are available from Fagerdala World Foams AB of Gustaysberg, Sweden. Other materials besides foam may be used. For example, an elastic or inelastic bladder filled with fluids (e.g., liquids and/or gases) may be used for some or all of the components.

The top layer 102 may have an elongated parallelepiped shape that has sufficient length to extend over the scapular zone 112, the sacrum/ischium/trochanter zone 114, and the thigh zone 116. In some embodiments, the end edge of the top layer 102 (closest to the heel end of the mattress) may be cut at an angle (e.g., downward sloping at about 45 degrees) to mate flush with a trapezoidal shaped calf pillow 104. Other angles may be used. The calf pillow 104 may have a relatively short length and a parallelepiped shape that only extends over the calf zone 118. By supporting the calves 814 with relatively firmer material, the heels 816 are effectively suspended and off-loaded. In some embodiments, the calf pillow 104 may have trapezoidal cross-sectional shape with angled edges.

The heel cushion 106 may have an irregular shape wherein the height or thickness varies over a length of the heel cushion 106. In some embodiments, the heel cushion 106 may have an increasing or decreasing thickness from the head end of the mattress 100 to the foot end of the mattress 100. In some embodiments, the sides of the heel cushion 106 may not be perpendicular to the major surfaces of the heel cushion 106. This shape allows the heel cushion 106 to sit on the foot end of the base structure 108 (which is sloped as shown in the drawings) and to maintain flush contact with the side of the calf pillow 104. Further, this shape also allows the heel end of the mattress 100 to have an even vertical edge despite the slope of the foot end of the base structure 108. In some embodiments where a trapezoidal shaped calf pillow 104 is used, and the edge of the heel cushion 106 (closest to the head end of the mattress) may be cut at an angle (e.g., upward sloping at 45 degrees) to mate flush with the trapezoidal shaped calf pillow 104. Other angles may be used.

The base structure 108 of the example mattress 100 has an irregular shape. There is a well or cut-out that spans the full width of the mattress 100 in the top surface of the base structure 108. The well has a trapezoidal cross-sectional shape and is disposed starting approximately thirty percent of the total length of the mattress 100 from the head end. In other words, in some embodiments, at approximately 25.5" from the head end of the mattress 100, the top surface of the base structure 108 angles downward at approximately 45 degrees to a vertical depth of approximately 3.5", continues horizontally for approximately 13", and then angles upward at approximately 45 degrees until the 5.5" height is reached. The top surface of the base structure extends approximately another 15.5" horizontally toward the foot end of the mattress 100 at the 5.5" height and then slopes downward at an approximately 7.5 degree angle for approximately 19" to the end of the base structure 108. The heel end of the base structure 108 may be approximately 3" thick. The downward slope of the base structure 108 at the foot end of the mattress 100 allows the heels to be more easily suspended by the calf pillow 104. It will be understood that the dimensions and angles provided are merely illustrative examples and that other dimensions and angles may be used.

The well in the base structure 108 may be approximately 3.5" deep and approximately 20" wide at the top and approximately 13" wide at the bottom. The well is specifically adapted to receive the core layer 110 such that when the core layer 110 is properly inserted into the well, the top surface of the base structure 108 is level and even with the top surface of the core layer 110. In addition, when the core layer 110 is properly inserted into the well, a smooth, level surface is available to make flush contact with the lower surface of the top layer 102. As will be discussed below with respect to FIG. 7, other mating core layer and well shapes and dimensions may be used.

In some embodiments, the mattress components 102, 104, 106, 108, 110 are assembled and held together by a fitted liner that surrounds the assembly but is stretchable in all directions to avoid suspending or "hammocking" the user. Alternatively, or in addition, the mattress components 102, 104, 106, 108, 110 may be fastened together permanently via, for example, a bonding agent, adhesive, or a heating process or non-permanently via, for example, hook and loop material or other releasable fastener.

In some embodiments, the liner may be formed from a gas permeable material that prevents liquids from passing through but allows gases to pass. Such a liner may be used to flow temperature-controlled air through the mattress to the patient to help control the patient's temperature. In some embodiments, the liner may further have non-permeable sides to better direct airflow up though the mattress 100.

In some embodiments, in addition to any liner, any sheets, covers, or "fire safety socks" used with mattress embodiments of the present invention are stretchable in all directions to avoid suspending or "hammocking" the user and to avoid interfering with the support of the mattress itself.

Figure 5:
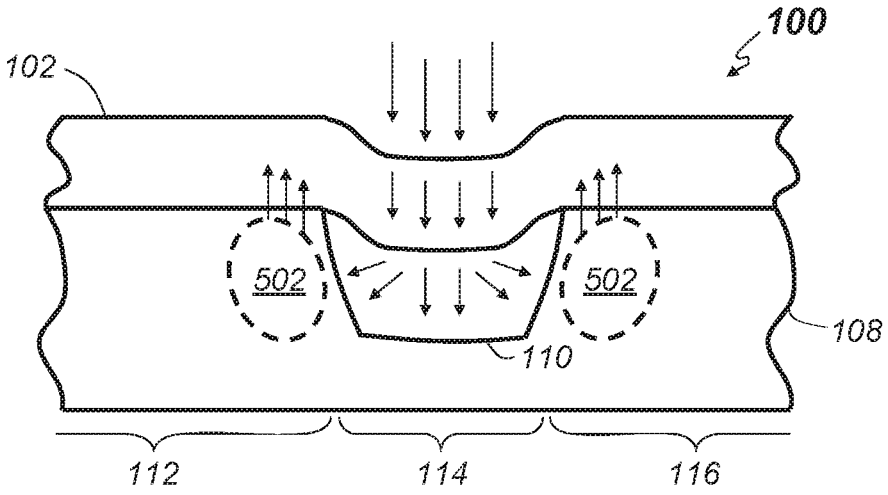
FIG. 5 illustrates a close-up cross-sectional partial side view depicting an example mattress according to embodiments.

Turning now to FIG. 5, the dynamic off-loading function of the mattress 100 is explained in more detail and illustrated using a close-up, cross-sectional view of the core layer 110 while under load. The partial cross-sectional view of the mattress 100 is taken along line 5-5 in FIG. 2.

The top layer 102 is constructed from a material that is relatively less dense and is adapted to easily contour to the patient's body with minimum pressure. In contrast, the material selected for the core layer 110 is relatively firmer and denser than the top layer 102. This material is adapted to provide support for the patient's weight. The material selected for the base structure 108 falls between the conforming top layer 102 and the firmer core layer 110 in terms of density and support. These three components are adapted to interact with each other and the weight of the patient to maintain maximum oxygen saturation in the tissue between the mattress and the boney prominences of the sacrum/ischium/trochanter.

As the patient's weight bears down on the top layer 102, some amount is supported and some weight and force is passed to the core layer 110 as represented by the downward pointing vector arrows and the deflection of the top layer 102 and the core layer 110 shown in FIG. 5. The sloped edges of the trapezoidal shaped core layer effectively translate some component of the downward force in a lateral direction as represented by the more horizontal pointing vector arrows. The sloped edges are thereby distended and forced to push out laterally into the base structure 108. The volumes of the base structure 108 proximate the core layer 110 indicated by the ovals drawn in phantom and labeled with reference numeral 502 are compressed by the laterally distended core layer 110.

The compression of these volumes 502 increases the density of base structure 108 proximate the core layer 110 by an amount related to the amount of weight bearing on the sacrum/ischium/trochanter zone 114. These volumes 502 of increased density provide additional support up to the patient in the scapular zone 112 and the thigh zone 116 as indicated by the upward pointing vector arrows. Thus, the effect of the mattress' structure and components' relative densities is to transfer pressure on the sacrum/ischium/trochanter zone 114 to the scapular zone 112 and the thigh zone 116 in proportion to the amount of weight brought to bear on the sacrum/ischium/trochanter zone 114. In other words, the more weight applied to the sacrum/ischium/trochanter zone 114, the more weight that can be supported by the adjacent volumes 502 of the scapular zone 112 and the thigh zone 116. The net effect is that the weight applied to the sacrum/ischium/trochanter zone 114 is dynamically off-loaded to the scapular zone 112 and the thigh zone 116 so that the scapular zone 112 and the thigh zone 116 may provide more support. "Dynamic" as used herein refers to when weight is first applied and compression of the sacrum/ischium/trochanter zone 114 first occurs. Once off-loading occurs, the weight is statically supported until the patient moves again.

The dynamic off-loading aspect of the present invention allows the same mattress 100 to be practicably used with different patients of different weights and widely varying body shapes and features. Further, the dynamic off-loading capability allows the mattress 100 to adjust to a patient's shifting weight and positions (e.g., prone, supine, side-laying) and/or from the use of an elevating support frame.

Figure 6:
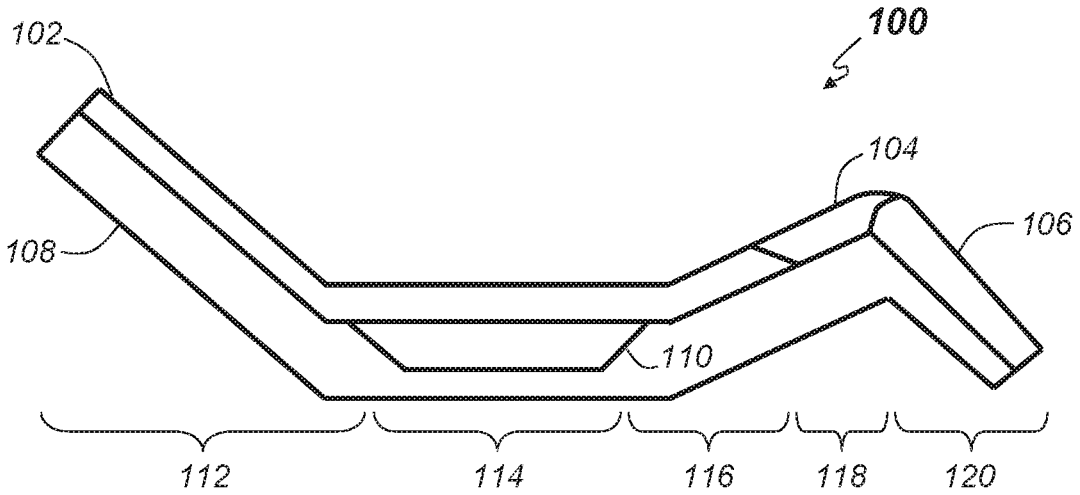
FIG. 6 illustrates a side view depicting an example mattress in an inclined position according to embodiments.

FIG. 6 illustrates a side view of the example mattress 100 as it may be supported by an elevating support frame. Note that the scapular zone 112 is inclined at approximately 45 degrees. Thus, as a result of the incline, some amount of the weight of the patient is shifted to the sacrum/ischium/trochanter zone 114. The increased weight at the sacrum/ischium/trochanter zone 114 means that the mattress will react by becoming more supportive (e.g., denser or firmer) in the scapular zone 112 and the thigh zone 116. Elevating support frames are typically adjustable though a range of incline angles. The mattress 100 of the present invention is adapted to adjust proportionately the off-loading support provided by the zones 112, 116 adjacent the sacrum/ischium/trochanter zone 114. In other words, as the incline angle changes, the amount of off-loading support changes in response to the shift of the user's weight to prevent blood flow restrictions. In some embodiments, the present invention may be used in other body supporting systems. For example, portions of the sacrum/ischium/trochanter zone 114 and adjacent zones 112, 116 may be used on an EMS backboard, wheelchair, desk chair, recliner, couch, or the like. The mattress of the present invention may, for example, be used on a standard bed frame, a gurney, a hospital bed, an ambulance bed, a surgical operating table, as a body support in a hyperbaric chamber, and in numerous other applications.

Figure 7:
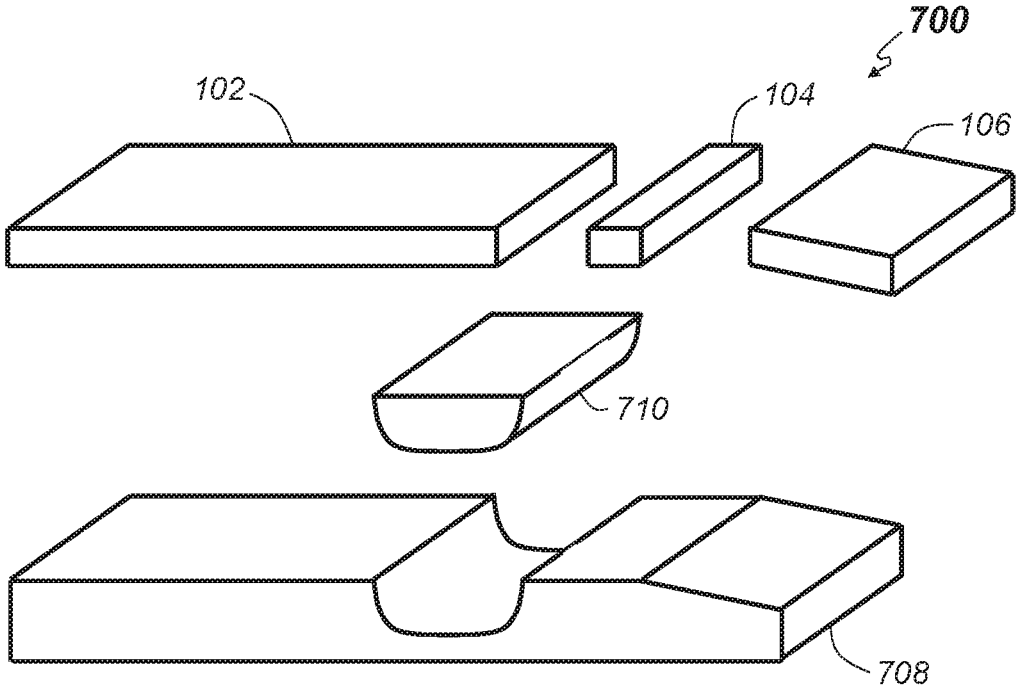
FIG. 7 is an exploded perspective view depicting a second example mattress according to embodiments.

Turning to FIG. 7, an alternate example embodiment of the mattress 700 of the present invention is illustrated in exploded perspective view. This example mattress 700 includes a well in the base structure 708 that has a parabolic shape and the mating core layer 710 has a matching parabolic shape. Other shapes are possible but the desired aspect of whatever shape is selected is that downward force on the top surface of the core layer 710 is translated into lateral expansion of the core layer 710 which compresses the laterally adjacent parts of the base structure 708.

Experimental Results

The performance of an example embodiment of the mattress of the present invention was tested in comparison to prior art mattresses to determine the relative ability of the mattresses to avoid blood flow restrictions. The prior art mattresses tested included a powered, equalized, low air loss, alternating-pressure mattress called the Pegasus microAIR Therapeutic Support System manufactured by Invacare Corporation of Cleveland, Ohio which alternates inflation and deflation of air cells to constantly change the points of pressure. A low air loss mattress, which supports a patient on air-filled cells while circulating air across the skin to reduce moisture and to help maintain a constant skin interface pressure, was also tested. Both of the prior art mattresses are significantly more expensive to manufacture and maintain than the mattress according to embodiments of the present invention. In addition, unlike the mattress according to embodiments of the present invention, these prior art mattresses also include powered components.

The average oxygen saturation in four sensing areas (scapula, sacrum, ischium, and heel) was measured over a period of time while a test subject was reclined in two different positions: supine (horizontal) and inclined at 30 degrees. A cerebral/somatic Invos Oximeter, Model 5100C manufactured by Somanetics Corporation was used to measure deep oxygen saturation percentages.

In the supine position, using the alternating mattress, the following average oxygen saturation measurements were made: scapula: 85.55%; sacrum: 88.70%; ischium: 86.41%; and heel: 50.07% for a total average oxygen saturation of 77.68%. In the inclined position, using the alternating mattress, the following average oxygen saturation measurements were made: scapula: 87.34%; sacrum: 89.07%; ischium: 89.50%; and heel: 53.17% for a total average oxygen saturation of 79.77%.

In the supine position, using the low air loss mattress, the following average oxygen saturation measurements were made: scapula: 84.98%; sacrum: 95.00%; ischium: 89.78%; and heel: 44.79% for a total average oxygen saturation of 78.64%. In the inclined position, using the low air loss mattress, the following average oxygen saturation measurements were made: scapula: 83.97%; sacrum: 95.00%; ischium: 91.79%; and heel: 47.61% for a total average oxygen saturation of 79.59%.

In the supine position, using a mattress according an embodiment of the present invention, the following average oxygen saturation measurements were made: scapula: 86.81%; sacrum: 95.00%; ischium: 94.59%; and heel: 53.39% for a total average oxygen saturation of 82.45%. In the inclined position, using an embodiment of mattress according to the present invention, the following average oxygen saturation measurements were made: scapula: 82.48%; sacrum: 95.00%; ischium: 94.84%; and heel: 60.30% for a total average oxygen saturation of 83.16%.

The above data clearly indicates that the performance (in terms of maintaining oxygen saturation in critical areas) of the embodiment of mattress of the present invention is similar to or better than the more expensive, powered prior art mattresses.

The foregoing description discloses only example embodiments of the invention. Modifications of the above disclosed apparatus and methods which fall within the invention's scope will be readily apparent to those of ordinary skill in the art. For instance, while bed mattress examples (e.g., standard bed frame, gurney, hospital bed, ambulance bed, surgical operating table, or the like) are described in the specification, the present invention may be applied as support cushions for EMS backboards, wheelchairs, chairs (e.g., desk chairs and recliners), couch seat cushions, or the like. In other words, the above could include support cushions with varying densities as described herein which are adapted to support a body while maintaining maximum blood flow/oxygen levels. Accordingly, while the present invention has been disclosed in connection with exemplary embodiments thereof, it should be understood that other embodiments may fall within the scope of the invention, as defined by the following claims.

The invention claimed is:

1. A mattress for preventing and treating pressure ulcers in bedfast patients, the mattress including:

a base structure having a length and a width including:

a first zone adapted to support a scapular area of a patient;

a second zone adjacent the first zone and adapted to support at least a sacrum area of the patient;

a well located in the second zone, the well fully spanning the width across a top surface of the base structure, the well also having at least two non-vertical sides extending from the top surface of the base structure; and a third zone adjacent the second zone and adapted to support a leg area of the patient, wherein the second zone includes a trapezoidal prism shaped layer adapted to fill the well and to compress the first and third zones based on weight applied to the second zone, the trapezoidal prism shaped layer having a top surface that is parallel to a bottom surface and at least two non-vertical sides extending between the top surface and the bottom surface, wherein the first zone and the second zone further include a top layer fully spanning the width across the top surface of the base structure; and wherein compressing the second zone increases the support provided to the patient by the first zone and compressing the second zone also increases the support provided to the patient by the third zone.

2. The mattress of claim 1 wherein the trapezoidal prism shaped layer is disposed to have the top surface facing the patient.

3. The mattress of claim 1 wherein the trapezoidal prism shaped layer is formed from foam material having a first density.

4. The mattress of claim 3 wherein the first and third zones are formed from foam material having at least a second density, and wherein the first density is different than the second density.

5. The mattress of claim 4 wherein the first density is greater than the second density.

6. The mattress of claim 3 wherein the third zone includes a calf zone formed from foam material having a third density greater than the first density.

7. The mattress of claim 1, wherein the base structure is formed from a single piece of material extending a full length of the mattress.

8. The mattress of claim 1, wherein the first zone and the third zone are thicker than the second zone where the well is located.

9. The mattress of claim 1, wherein the top surface of the trapezoidal prism shaped layer is longer than the bottom surface of the trapezoidal prism shaped layer.

* * * * *